US005147464A

United States Patent [19]

Skovron

[11] Patent Number: 5,147,464

[45] Date of Patent: Sep. 15, 1992

[54] ELECTRIC FUEL INJECTION CLEANER APPARATUS AND METHOD

[75] Inventor: Alan Skovron, Sydney, Australia

[73] Assignee: High Tech Auto Tools Pty. Ltd., Sydney, Australia

[21] Appl. No.: 479,449

[22] Filed: Feb. 14, 1990

[30] Foreign Application Priority Data

Feb. 14, 1989 [AU] Australia ..... PJ2727

[51] Int. Cl.[5] ..... B08B 9/00

[52] U.S. Cl. ..... 134/1; 134/184

[58] Field of Search ..... 134/1, 184

[56] References Cited

U.S. PATENT DOCUMENTS 4,082,565 4/1978 Sjolander ..... 134/1

FOREIGN PATENT DOCUMENTS 3146478 6/1984 Fed. Rep. of Germany ..... 134/1

3614960 11/1987 Fed. Rep. of Germany ..... 134/1

*Primary Examiner*—Asok Pal

*Attorney, Agent, or Firm*—Darby & Darby

[57] ABSTRACT

A method of cleaning an electronic fuel injector having an inlet and an outlet, comprising the steps of supporting an electronic fuel injector in an ultrasonic bath of cleaning fluid such that at least the outlet tip is immersed in the fluid, resonating said bath at a frequency between 1.0 and 50 $kH_z$ and pulsing said injector between 1.0 and 40 msec at a R.P.M. of between 50 and 15,000, whereby the cleaning fluid, while being resonated by the ultrasonics, flows in a reverse direction from said bath into the injector outlet, through said injector, and out of the injector inlet, as a result of the interaction of the ultrasonics and said pulsing of said injector.

12 Claims, 3 Drawing Sheets

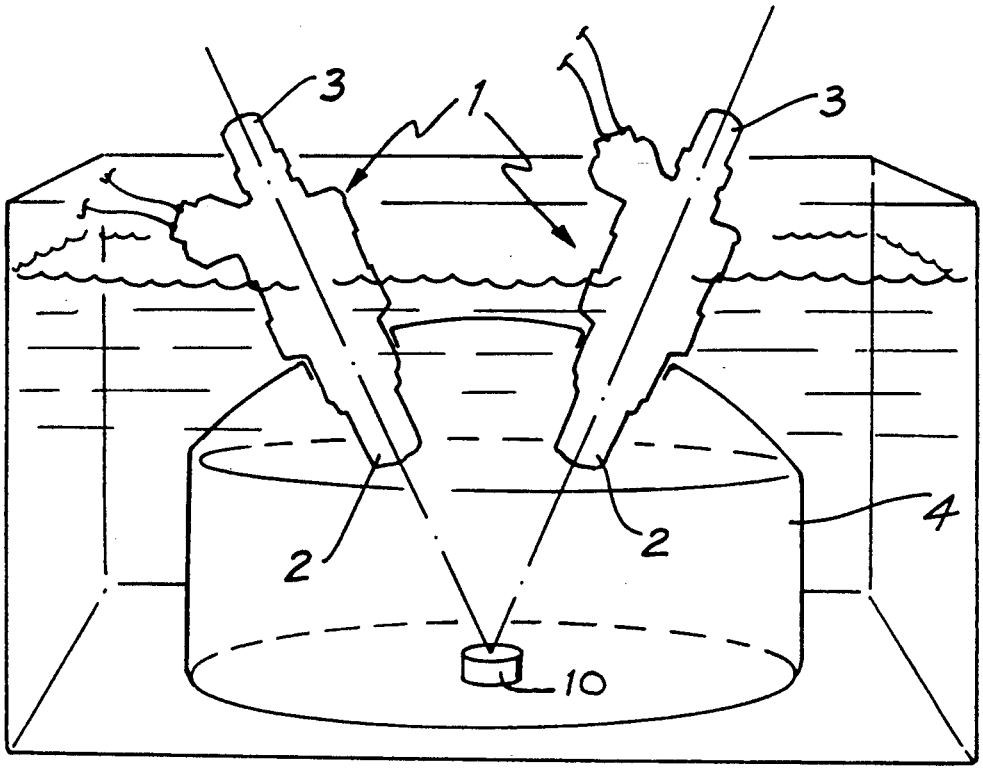
FIG. 2
FIG. 3
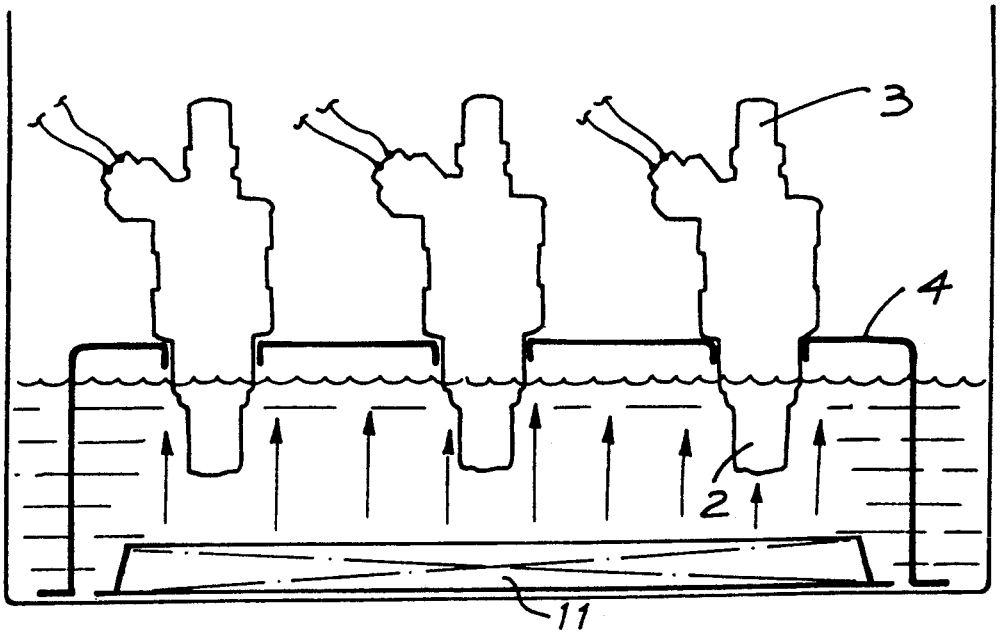

ELECTRIC FUEL INJECTION CLEANER APPARATUS AND METHOD

The present invention rolates to an apparatus and method for cleaning electronic fuel injectors, and other electronic controlled injections such as air injectors.

Prior art methods of cleaning electronic fuel injectors generally comprised of two methods. The first utilizes immersing the injectors or injector tips in an ultrasonic bath of cleaning fluid. This method, however, only cleans the injector nozzle tip and the filter basket. A second method, such as the RAM FIC-109 system, utilizes a forced flow and/or forced back flow of cleaning fluid though the injector. Whilst each system has its advantages, they also have their disadvantages in that they do not fully clean all of the pathway of the injector and hence the injector will not operate at optimum efficiency or may need to be replaced.

A third method is that described in U.S. Pat. No. 4,082,565. This device uses a gravity feed of cleaning fluid through the injectors in the normal direction as they are being periodically pulsed with tips being immersed in an ultrasonic bath. This method suffers from disadvantages in that it does not allow impurity particles trapped in the filter basket to be readily removed during cleaning and also requires a separate reservoir of cleaning fluid and connections to the inlets of the injectors to flow fluid therethrough. The present invention seeks to ameliorate the disadvantage by providing a method and apparatus for cleaning injectors which allows readily flushing out of the filter basket of the injector.

In one broad form the invention comprises a method of cleaning an electronic fuel injector comprising the steps of supporting an electronic fuel injector in a bath of cleaning fluid such that at least the outlet tip is immersed and then pulsing said injector at frequencies such that the cleaning fluid flows in the reverse direction through the injector.

In another broad form the invention provides a method of cleaning an electronic fuel injector comprising the steps of supporting an electronic fuel injector in an ultrasonic bath of cleaning fluid such that at least the outlet tip is immersed and pulsing said injector whereby the cleaning fluid, while being resonated by the ultrasonics, flows in the reverse direction through the injector as a result of the interaction of the ultrasonics and the pulsing of the injector.

In another broad form the invention comprises a method of cleaning an electronic fuel injector comprising the steps of supporting an electronic fuel injector in an ultrasonic bath of cleaning fluid such that at least the inlet of the fuel injector is immersed in the cleaning fluid, and pulsing said injector such that the cleaning fluid flows upwardly through the injector as a result of the interaction of the ultrasonics and the pulsing of the injector.

BRIEF DESCRIPTION OF DRAWINGS

The present invention will now be described with reference to the accompanying drawings in which:

FIG. 2 illustrates schematically a group of injectors being held in position for cleaning in accordance with one embodiment of the present invention;

FIG. 3 illustrates schematically a group of injectors being held in position for cleaning in accordance with a further embodiment of the present invention;

Figure 1:
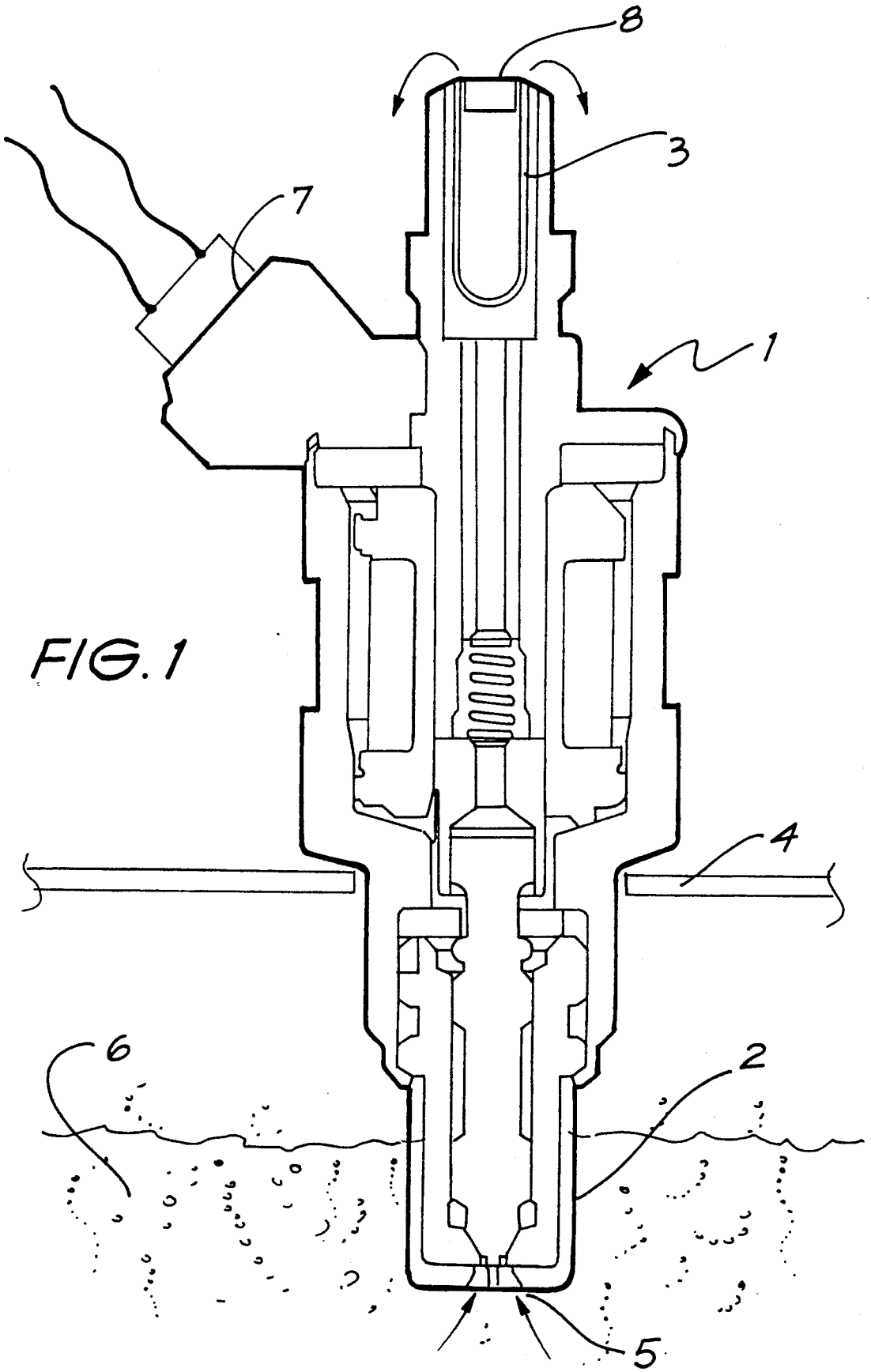
FIG. 1 shows schematically a partially sectional view of an injector positioned in one embodiment of the present invention.

Further if a plastic, nylon, or other non-metallic filter basket is used weaker cleaning fluids must be used to prevent degradation of the plastic, nylon or other non-metallic basket. In the case of full immersion in the ultrasonic bath, degradation of plastic, nylon or other non-metallic components of the injector can occur.

In the embodiment of the present invention shown in FIG. (1) the fuel injector (1) is held in a plate (4) with the injector outlet nozzle (5) submerged in the cleaning fluid (6) of an ultrasonic bath (not shown) and is connected to the solenoid input (7). The injector (1) is pulsed at 1.0–40.0 m sec at a R.P.M. of between 50–15,000, with the ultrasonic at a frequency of between 10 to 50 kHz.

Preferably, as shown in FIG. 2, the outlet tips (5) are held in a holder (9) such that they are aligned with the epicentre (10) of the transducer, or in the case of a flat or mat transducer (11) the outlet tips 5 are aligned vertically above the transducer to produce optimum ultrasonic interaction to improve the reverse flow and cleaning. Preferably the ultrasonics are operated at a frequency in the range of 25–30 kHz.

Because of the interaction between pulsing of the injector and the ultrasonic resonating of the cleaning fluid, the cleaning fluid (6) flows into the outlet nozzle (2) of the injector and back flows though the filter basket (3) and out of the open inlet (8) of the injector. The cleaning fluid (6) as it flows up through the injector (1) is resonated by the ultrasonics and effectively removes the deposits and residues from all the surfaces throughout the flow path of injector.

Any suitable cleaning fluid can be used such as white spirits, RAM 903 or RAM 904, or warm water with caustic soda if a plastic, nylon or other non-metallic filter basket is used or Carbolsol NF in the case of a metal filter basket. Ideally High Tech's own specially formulated ASNU injector cleaning fluid should be used.

Figure 4:
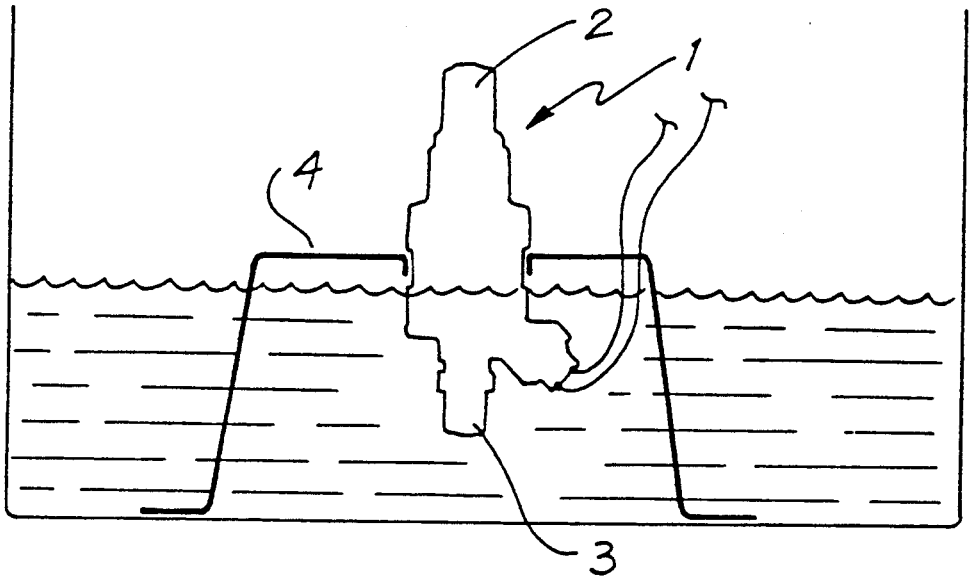
FIG. 4 illustrates schematically another means of holding an injector for cleaning in accordance with another embodiment of the present invention.

The injectors (1) could be held in an upright position as shown in FIG. 4 wherein the inlet (8) of the injector is immersed in the cleaning fluid (6) and the injectors (1) pushed to draw cleaning fluid through the connectors.

Preferably the cleaning fluid is resonated by ultrasonics at a frequency of between 20 kHz–30 kHz.

Figure 5:
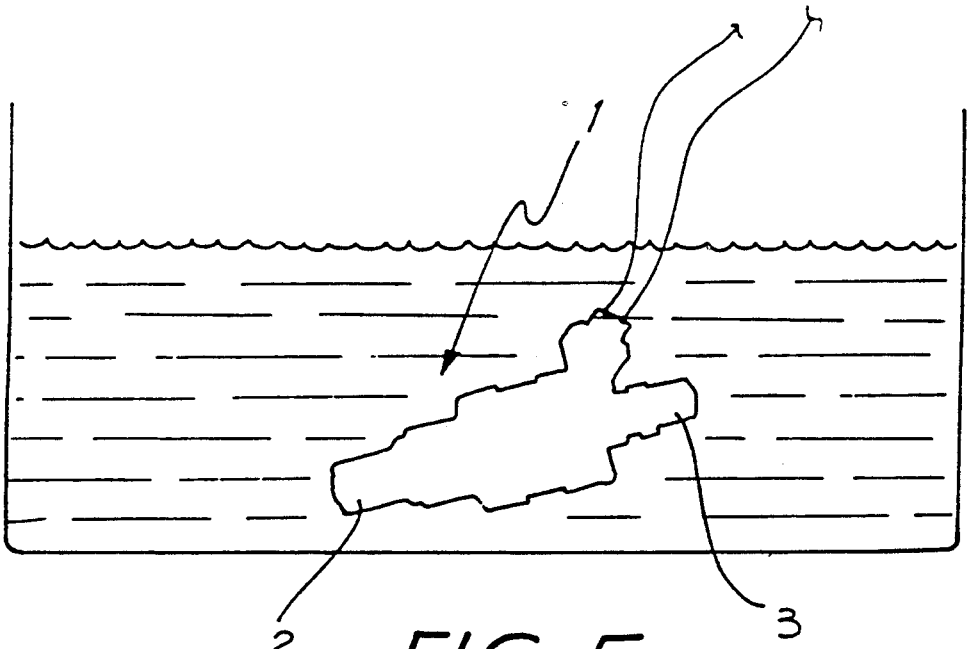
FIG. 5 illustrates schematically another method of cleaning in accordance with a further embodiment of the present invention In electronic fuel injectors, deposits build up around the nozzle tip, causing the petrol to issue as a stream of fuel, rather than as a fine spray, resulting in a loss of power. Further the filter basket (3) can blocked, restricting the flow of petrol through the injectors. Deposits can also, and do, build up around the shaft of the injector pin and on the internal surface of the petrol flow paths thus resulting in loss of efficiency of the injector. The prior art methods do not adequately clean the injector as, for example, with the use of an ultrasonic bath on its own, the ultrasonics only effectively interact with deposits at the very tip of outlet and do not always remove all of the residue from the filter basket, while with the foroed flow or back flow under pressure of cleaning fluid through the injector, reliance is only placed on the cleaning property of the fluid flow and/or pressure to remove the deposits.

The injectors (1) could be fully immersed as shown in FIG. 5 with the injectors (1) pulsed to provide flow in either direction or in alternate direction or in alternate directions for specific periods of time. Preferably the cleaning fluid is resonated by ultrasonics.

It should be obvious to people skilled in the art that modifications and alterations can be made to the above without departing from the spirit or scope of the present invention.

I claim:

1. A method of cleaning an electronic fuel injector having an inlet and an outlet, comprising the steps of supporting an electronic fuel injector in an ultrasonic bath of cleaning fluid such that at least the outlet tip is immersed in the fluid, resonating said bath with ultrasonic energy, and pulsing said injector at a rate which causes the cleaning fluid to flow in a reverse direction from the bath, into the injector outlet, through said injector, and out of the injector inlet, as a result of the interaction of the ultrasonic resonance and said pulsing action of said injector.

2. A method of cleaning an electronic fuel injector according to claim 1 wherein said ultrasonic energy is applied to said bath by a transducer, said injector being aligned with the epicenter of said transducer.

3. A method of cleaning an electronic fuel injector according to claim 1 wherein said transducer is a mat transducer and said injector is aligned substantially normal thereto.

4. A method of cleaning an electronic fuel injector according to claim 1 wherein said cleaning fluid is white spirits.

5. A method of cleaning an electronic fuel injector according to claim 1 wherein said cleaning fluid is carbolcol NF.

6. A method of cleaning an electronic fuel injector according to claim 1 wherein said cleaning fluid is ASNU injector cleaning fluid.

7. A method of cleaning an electronic fuel injector having an inlet and an outlet, comprising the steps of supporting an electronic fuel injector in an ultrasonic bath of cleaning fluid such that at least the outlet tip is immersed in the fluid, resonating said bath at a frequency between 1.0 and 50 $kH_z$ and pulsing said injector between 1.0 and 40 msec at a R.P.M. of between 50 and 15,000, whereby the cleaning fluid, while being resonated by the ultrasonics, flows in a reverse direction from said bath into the injector outlet, through said injector, and out of the injector inlet, as a result of the interaction of the ultrasonics and said pulsing of said injector.

8. A method of cleaning an electronic fuel injector according to claim 7 wherein said ultrasonic bath has a transducer positioned therein to perform said resonating step, said injector being aligned with the epicenter of said transducer.

9. A method of cleaning an electronic fuel injector according to claim 7 wherein said transducer is a mat transducer and said injector is aligned substantially normal thereto.

10. A method of cleaning an electronic fuel injector according to claim 7 wherein the cleaning fluid is white spirits.

11. A method of cleaning an electronic fuel injector according to claim 7 wherein said cleaning fluid is carbolcol NF.

12. A method of cleaning an electronic fuel injector according to claim 7 wherein said cleaning fluid is ASNU injector cleaning fluid.

* * * * *